United States Patent [19]

Boyesen

[11] 4,202,298

[45] * May 13, 1980

[54] FUEL PORTING FOR TWO CYCLE INTERNAL COMBUSTION ENGINE

[75] Inventor: Eyvind Boyesen, Kempton, Pa.

[73] Assignee: Performance Industries, Inc., Kempton, Pa.

[ * ] Notice: The portion of the term of this patent subsequent to Jul. 17, 1996, has been disclaimed.

[21] Appl. No.: 941,596

[22] Filed: Sep. 12, 1978

Related U.S. Application Data

[63] Continuation-in-part of Ser. No. 859,476, Dec. 12, 1977, and a continuation-in-part of Ser. No. 839,180, Oct. 4, 1977, which is a continuation-in-part of Ser. No. 674,102, Apr. 6, 1976, Pat. No. 4,062,331, which is a continuation-in-part of Ser. No. 586,138, Jun. 11, 1975, Pat. No. 4,051,820, which is a continuation-in-part of Ser. No. 375,065, Jun. 29, 1973, Pat. No. 3,905,340, which is a continuation-in-part of Ser. No. 282,734, Aug. 22, 1972, abandoned, which is a continuation-in-part of Ser. No. 361,407, May 18, 1973, abandoned.

[51] Int. Cl.[2] ..... F02B 33/00

[52] U.S. Cl. ..... 123/73 R; 123/73 A

[58] Field of Search ..... 123/73 R, 73 A, 73 AA, 123/73 PP, 73 V, 73 B, 73 SP, 74 R, 74 A, 65 P, 65 WV, 65 E, 73 D, 73 AF

[56] References Cited

U.S. PATENT DOCUMENTS

| | | | |
|---|---|---|---|
| 3,107,659 | 10/1963 | Steinlein et al. | 123/73 R |
| 3,687,118 | 8/1972 | Nomura | 123/73 R |
| 3,905,340 | 9/1975 | Boyesen | 123/73 A |
| 3,905,341 | 9/1975 | Boyesen | 123/73 R |
| 4,000,723 | 1/1977 | Boyesen | 123/73 R |
| 4,051,820 | 10/1977 | Boyesen | 123/73 A |
| 4,062,331 | 12/1977 | Boyesen | 123/73 A |
| 4,143,626 | 3/1979 | Boyesen | 123/73 A |
| 4,161,163 | 7/1979 | Boyesen | 123/73 A |

*Primary Examiner*—Wendell E. Burns
*Attorney, Agent, or Firm*—John T. Synnestvedt; Kenneth P. Synnestvedt

[57] ABSTRACT

Fuel porting and passage arrangements including transfer porting and passages between the crankcase and the combustion side of the piston, together with intake porting and passage arrangements for delivering fuel to the crankcase. The transfer and intake passages include portions of regions common to both or in communication with each other in relationships providing not only for direct delivery of fuel to the crankcase but also for augmenting fuel transfer into the combustion space.

9 Claims, 8 Drawing Figures

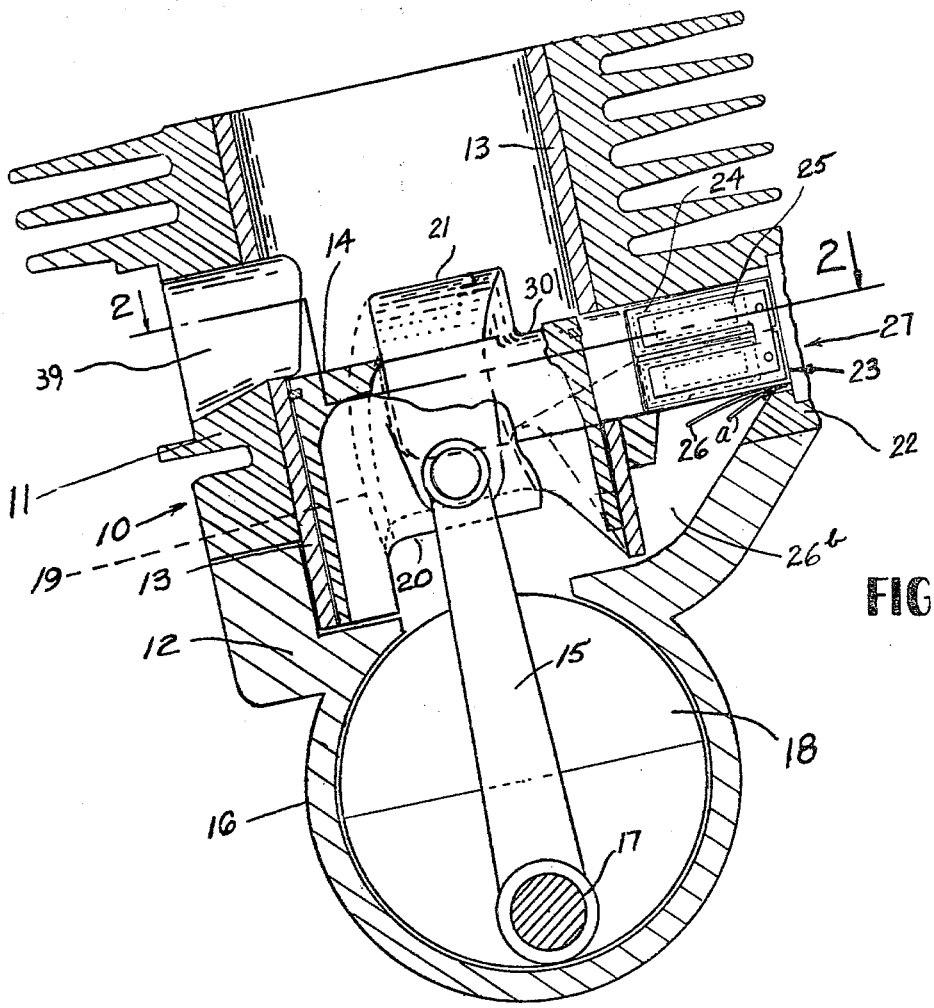
FIG. 1
FIG. 2
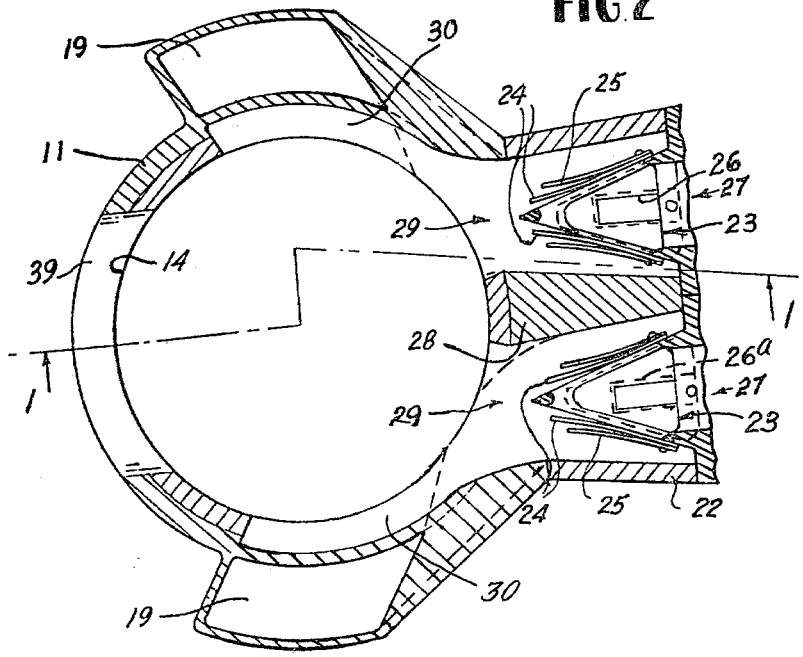

11b
39
21b
36
36'
TDC
4
14b
W
4
13b
29b
27b
19b
W'
37
22b
38
BDC
30b
13b
12b
40
13b 19b
30b
11b
W
39
14b
29b
23b
27b
3
28b
3
13b
29b
23b
27b
19b
30b
22b

FUEL PORTING FOR TWO CYCLE INTERNAL COMBUSTION ENGINE

CROSS REFERENCES

The present application is a continuation-in-part of application Ser. No. 859,476, filed Dec. 12, 1977, and of application Ser. No. 839,180, filed Oct. 4, 1977, which applications are continuations-in-part of certain earlier applications including Ser. No. 674,102, filed Apr. 6, 1976, and issued Dec. 13, 1977, as U.S. Pat. No. 4,062,331, Ser. No. 586,138, filed June 11, 1975, and issued Oct. 4, 1977, as U.S. Pat. No. 4,051,820, which, in its turn, is a continuation-in-part of my application Ser. No. 375,065, filed June 29, 1973, and issued Sept. 16, 1975, as U.S. Pat. No. 3,905,340, which, in its turn, is a continuation-in-part of my prior application Ser. No. 282,734, filed Aug. 22, 1972, now abandoned, and also of my prior application Ser. No. 361,407, filed May 18, 1973, now abandoned.

BACKGROUND OF THE INVENTION

Two cycle internal combustion engines are commonly provided with transfer passages and porting providing for delivery of fuel from the crankcase into the combustion chamber above the piston. Intake porting is provided in order to introduce fuel into the crankcase space for compression therein upon the downward stroke of the piston and for delivery from the crankcase space through the transfer passage means. Intake valves are commonly provided in the intake passageway or intake tract.

The present invention is concerned with improvements in passage and porting arrangements both in the transfer and in the intake system providing for increase in delivery of fuel into the combustion chamber above the piston. The increase in fuel delivery and the consequent improvement in operation of the engine are accomplished according to the present invention by providing a novel interrelationship between the intake porting and passages and the transfer porting and passages, according to which the intake porting and passages not only deliver the fuel to the crankcase space, but also deliver fuel by an injector type of action into the transfer fuel flow during the phase of the cycle of operation in which fuel is being transferred from the crankcase to the combustion chamber.

In the arrangements according to the present invention, reed type intake valves are preferably provided in the intake tract, and injector porting or passages are provided in order to deliver fuel from the intake tract substantially directly into the transfer passage means. According to the invention, this may be accomplished in several ways by providing a region of at least one transfer passage intermediate its ends in communication with the intake passage or tract downstream of the valve means. Indeed, in certain arrangements according to the invention, a region of the intake tract downstream of the valve means and a region of at least one transfer passage intermediate its ends are common to each other.

Several embodiments of engines providing improved operation as referred to above are illustrated in the accompanying drawings and described hereinafter.

BRIEF DESCRIPTION OF DRAWINGS

FIG. 1 is a view in section, taken along the line 1—1 of FIG. 2, and illustrating a two cycle reed valve engine having intake and injector porting according to one embodiment of the invention;

FIG. 2 is a sectional view taken along the line 2—2 of FIG. 1;

DETAILED DESCRIPTION

FIGS. 1 and 2

Figure 3:
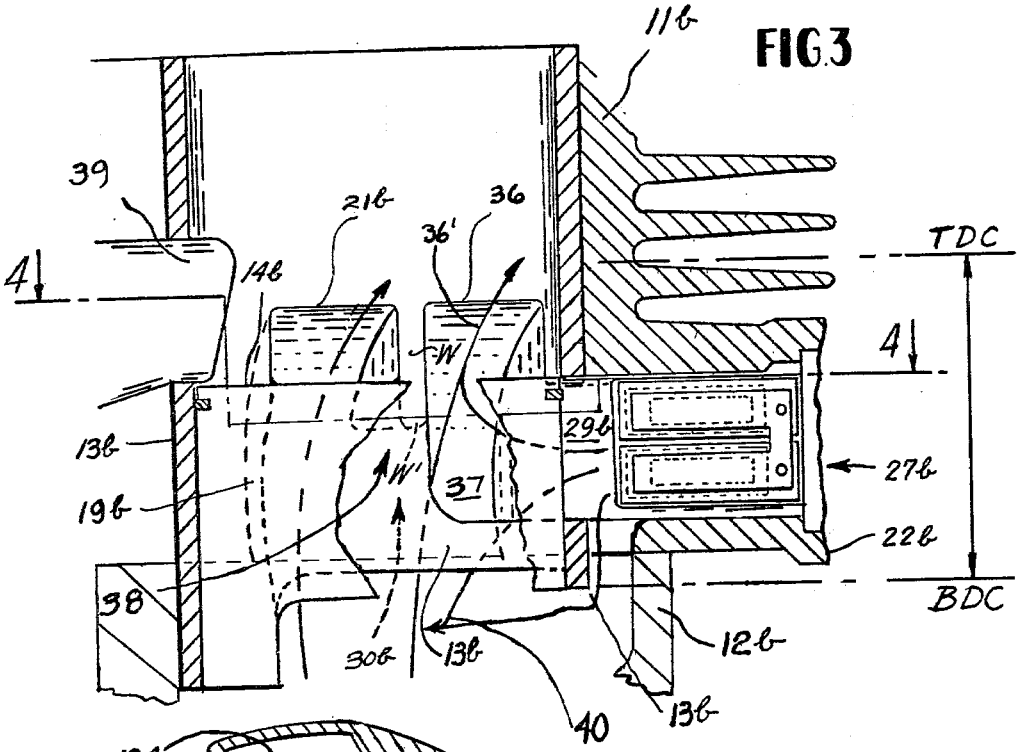
FIG. 3 is a view similar to FIG. 1 but omitting most of the crankcase, the view being taken along the line 3—3 on FIG. 4 and illustrating a second embodiment of the invention.

Before considering the drawings in detail, it is first pointed out that FIGS. 1 and 2 are respectively the same as FIGS. 1 and 2 of my prior application Ser. No. 859,476 identified above. Since the structure which appears in FIGS. 1 and 2 is shown and described in the companion application referred to, reference may be had to said companion application for further amplification. Significant parts of the apparatus shown in these figures is described herebelow, and certain portions of this description correspond to portions appearing in the companion application where the structural features are the same.

In FIGS. 1 and 2, there is shown a somewhat diagrammatic representation of a two-cycle engine comprised of a housing 10 the upper portion of which defines a cylinder 11 and the lower portion of which defines a crankcase 12. The upper, annular portion of the crankcase interfits with cylinder liner structure 13, which extends throughout the height of the cylinder 11, except where omitted or removed to provide certain porting (including the usual exhaust port 39), and projects beneath it in the manner plain from FIG. 1. While the use of a liner is preferred, it is not essential, and for most purposes of the present invention, the liner can be considered as a part of the cylinder 11, which, in turn, forms the upper portion of housing 10. A piston 14 is mounted for reciprocation within the cylinder and its connecting rod 15 is eccentrically mounted upon the crankshaft within the lower portion 16 of the crankcase, as indicated at 17. As is conventional, a circular counterweight is preferably employed, as shown at 18.

The cylinder 11 includes transfer passages 19, the lower end of each of which is in open communication with the crankcase and the upper end of each of which terminates in a port 21 opening through the cylinder wall and into the space lying to the combustion side of piston 14. As will be understood, it is preferred to employ at least two such transfer passages (see FIG. 2) and one thereof appears in FIG. 1 at 19, its lower end 20 having the stated open communication with the crankcase and its upper end terminating in the aforesaid port shown at 21. Conveniently, and as shown, the passage 19 is provided in the wall of cylinder 11, lying behind the liner 13, which is apertured to provide the lower communication at 20 as well as the upper port 21. As is conventional, combustable gases inletted during the upward stroke are pressurized beneath the piston and in the crankcase, by the piston throughout its downward stroke toward the bottom dead center position illustrated, and the gases flow from the crankcase through openings 20, passages 19 and ports 21, from whence the gases enter the cylinder above the piston 14.

The cylinder 11 also includes an intake chamber 22 which leads to a source of fuel (not illustrated) and which chamber contains the reed valve means 23, which is adapted to open and provide for intake of fuel throughout the entire upward stroke of the piston, and to close, during the downward stroke of the piston, when the fuel inletted into the space below the piston is being compressed. While, for certain purposes of the present invention, the reed valve means 23 may take a variety of forms known in the art, it is preferred that said reed valve means be of the so-called "vented" type described and claimed in my earlier disclosures and particularly in U.S. Pat. No. 3,905,340, to which reference may be had for a more detailed description. It is also preferred that the valve means includes a plurality of valve assemblies as described hereinafter.

In the embodiment illustrated in FIGS. 1 and 2, the reed valve means 23 includes a reed valve body or cage of wedge shape, with the base end of the wedge open to the fuel supply passage, each inwardly inclined surface of the wedge-shaped cage having a pair of valve ports and each such port provided with primary and secondary reeds 24 and 25, the primary reeds being vented. This valving arrangement is more fully illustrated and described in my U.S. Pat. No. 3,905,340 above identified.

The opposite sides or ends (top and bottom) of the reed valve cage are provided with parallel triangular walls; and in the construction shown in FIGS. 1 and 2, the lower triangular wall of the valve cage is provided with a valve port 26 with which a pair or primary and secondary reed valves 26*a* are associated. In this case also, the primary reed is vented and is of the general type described in my prior U.S. Pat. No. 3,905,340.

From FIG. 2, it will be seen that the embodiment of FIGS. 1 and 2 includes two valve assemblies 23 arranged in side-by-side relation and positioned respectively in separate intake passages 29,29 lying at opposite sides of the dividing wall 28. The fuel entering through the valves 24, 25 flows directly into the cylinder intake passages 29 and also laterally and downwardly into the intake passages 26*b*, referred to hereinafter. From FIG. 1, it will also be seen that the intake passages 26*b* are extended downwardly and laterally from the lower side of each reed cage and thereby provide communication with the crankcase independently of the passages 29. The reed valves 26*a* of each valve assembly control the fuel flow from the interior of the reed cage into the associated intake passage 26*b*, and this flow joins the downward fuel inlet flow coming from the valves 24, 25. From FIG. 1, it will also be observed that the passages 26*b* communicate with the crankcase at a point below the piston skirt laterally at each side of the vertical plane of the reed cages, even when the piston is in BDC, as in FIG. 1. The communication through the valves 26*a*, the passages 26*b* and into the crankcase, is thus maintained throughout the entire cycle of operation of the engine, and the flow would, of course, only be terminated when the compression is occurring in the crankcase, with consequent increase in pressure communicated back to the valve structure, thereby permitting the valves 26*a* to close.

It is desirable, as shown in FIGS. 1 and 2, that each reed cage be positioned with its apex extended in a vertical direction, i.e., in a direction parallelling the axis of the cylinder. When positioned in the manner just referred to, it will be clear from inspection of FIG. 2 that the flow of fuel through the valve ports controlled by the reed valves or petals 24 and 25 substantially directly enters the passages downstream of the valves, without the necessity for any extensive or sharp angular deflection. Similarly, the flow of the fuel into the inclined passages 26*b* when the reed valves 26*a* are opened is a substantially direct flow not requiring sharp or extensive angular change in direction. These and other factors are of importance in maximizing the input of fuel into the engine.

The above mentioned directness of flow is enhanced by virtue of the arrangement as shown in which a pair of reed valve assemblies are mounted in separate generally parallel intake passages 27,27, as established by intervening wall structure including partition 28.

A plurality of injector passages are provided at each side of the cylinder; and in the embodiment of FIGS. 1 and 2, where a single transfer passage is provided at each side of the cylinder, there are two injector passages at each side, both of which interconnect the fuel inlet means with the same transfer passage. Thus, in this embodiment, there are provided injector passages 30—30 in the form of a pair of cavities each recessed in the wall of the cylinder in a position in which its open side confronts an outer side wall portion of the piston 14. These passages are of open construction, facilitating casting of the cylinder, making possible the employment of injector passages of larger cross section, and promoting smoother fluid flow. The outer side wall of piston 14 provides the inner wall limit (considered radially of the cylinder) of each injector passage 30, as appears in FIG. 2, and each interconnects one of the intake ports 29 with the transfer passage at that side of the cylinder. The connection or junction of the injector passage with the transfer passage is immediately adjacent to the transfer port 21.

The injector passages 30 are similar in general function to passages described and claimed in U.S. Pat. No. 3,905,341, being open throughout the complete cycle and serving to increase intake of fuel throughout the RPM range of the engine. When the charge contained in the crankcase 16 is pressurized by the descending piston 14, such charge flows upwardly through the transfer passages 19 to the transfer ports 21 and into the cylinder. This flow takes place at high velocity; and the rapidly moving charge in the passage 19 causes an eductor effect in the injector passages 30 which, in turn, causes relatively low pressure to exist through such passages. Accordingly, fuel is drawn from the intake tract downstream from the valve assembly, through the injector passages 30, and into the transfer passages 19. It is to be noted that the arrangement of these passages and ports provided by the present invention is such as to provide for only one-way flow in any one passage.

A second pair of injector passages is provided at each side of the cylinder in the embodiment shown in FIGS. 1 and 2. Each of these additional injector passages is indicated at 30*a*, and from FIG. 1, it will be seen that these passages are downwardly inclined. Each of these passages interconnects the intake system with the transfer passage 19 at that side of the cylinder in a position close to the lower end of the transfer passage, so that the injector passages at each side of the cylinder are associated respectively with the upper and the lower portions of the transfer passage.

As is pointed out in U.S. Pat. No. 3,905,341, and graphically portrayed therein the peak horsepower of an engine is raised considerably by the use of injector porting. By employing the porting, especially in combination with the extended intake porting characteristic of various embodiments of the present invention, I have found that it is possible to further increase fuel delivery throughout the cycle, and thereby to maximize power. This is particularly true with respect to the multiple injector port arrangements of FIGS. 1 and 2.

With reference to the orientation of the engine and reed valves as shown in FIG. 1, it should be kept in mind that in many installations, particularly in motorcycles and snowmobiles, the intake passage of a two-cycle engine, and also the engine itself, is somewhat inclined in a direction such that liquid fuel tends to flow from the carburetor (not shown) to the intake passage or chamber 22 and toward intake port 29. Such inclination is shown in FIG. 1.

The injector passages are each arranged at a substantial angle with respect to the axis of the adjacent transfer passage 19, which terminates in the transfer port 21. As will be appreciated, the port of each transfer passage lies above the piston 14 when the latter, as shown fragmentarily in FIG. 1, occupies its bottom dead center position (BDC).

From the above, it will be seen that in the embodiment of FIGS. 1 and 2, provision is made for extensive intercommunication between the intake tract and the transfer passage and that the injector intercommunication between the intake and the transfer passages occurs in regions spread along the length of the transfer passages.

Figure 4:
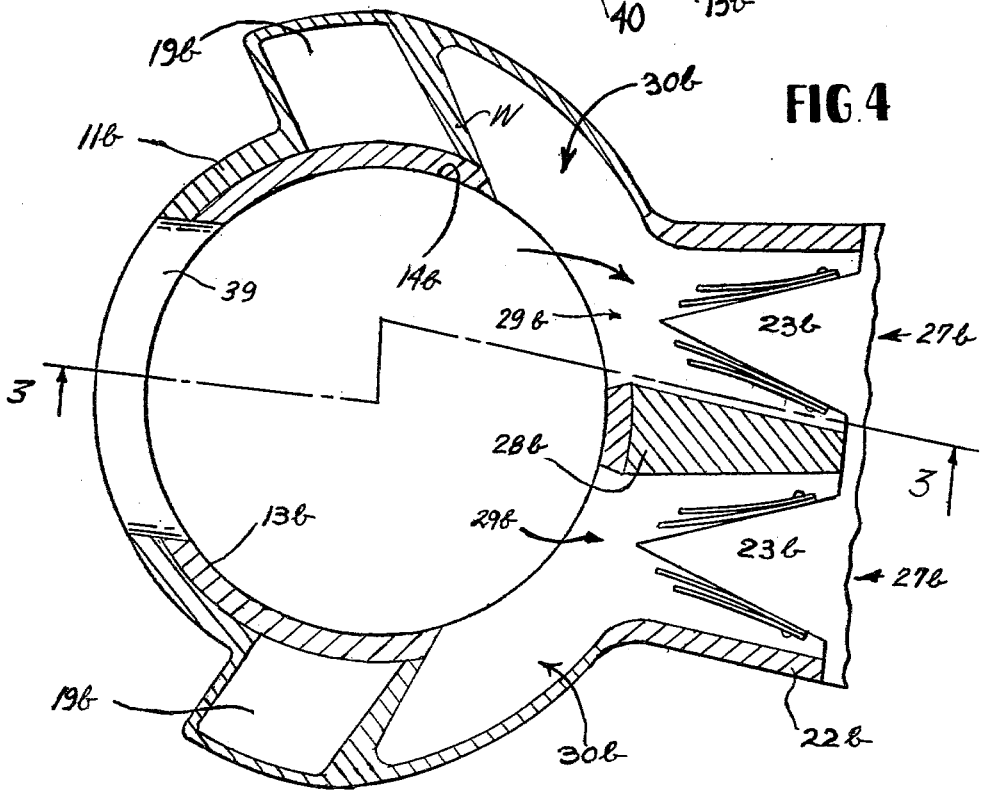
FIG. 4 is a sectional view of the apparatus of FIG. 3 taken along the line 3—3 of FIG. 4.

FIGS. 3 and 4

This embodiment is also disclosed in my application Ser. No. 674,102, filed Apr. 6, 1976, and issued Dec. 13, 1977, as U.S. Pat. No. 4,062,331, and significant features thereof are still further disclosed in my prior application Ser. No. 859,476, filed Dec. 12, 1977; and reference may be made to those prior applications for further amplification.

Turning to FIGS. 3 and 4, in which similar parts bear similar reference numerals including the subscript b, it will be seen that this third embodiment also utilizes injector porting which comprises a pair of passages 30*b*,30*b* formed by removing portions of liner 13*b* and of cylinder structure 11*b*. Again each injector passage 30*b* comprises a cavity in the cylinder and liner, and interconnects the intake porting 29*b* with the transfer passage 19*b*.

In this embodiment, instead of employing only a single transfer port and passage at each side of the cylinder, a pair of adjacent ports are employed, each opening separately into the combustion space of the cylinder, as seen most clearly in FIG. 3. These ports are the transfer port 21*b* and an auxiliary inlet port 36 which has a dual function serving the purposes of a transfer port (see the flow arrow 36') and which also is fed directly from the intake porting 29*b* through the cavity region just beneath the auxiliary port 36. As is revealed by the broken-away central portion of the piston in FIG. 3, a cavity portion 37 opens directly through the wall of liner 13*b*, while another adjacent cavity portion 38 is formed in the cylinder behind the liner. These cavity portions 37 and 38, together comprise an injector passage 30*b*, the cavity portion 37 serving also as a means for directly feeding the port 36 in its auxiliary inlet function. Thus, the auxiliary port 36 is in free communication not only with the injector passage 30*b* (formed by cavity portions 37 and 38), but also with the transfer passage 19*b*, and its port 21*b*. Wall w lying between the ports 21*b* and 36 supports the piston, in the region of those ports, but this wall terminates at $W^1$, as shown in FIG. 3, just below the plane of section line 3—3, leaving the cavity portions 37 and 38 in free communication with each other. As in the other embodiments, the intake porting 29*b* has vertical extent sufficient to provide fuel intake immediately below the piston, as shown by arrow 40, even when the piston is at BDC.

A particular advantage of this form of the invention lies in the fact that it eliminates short circuiting of fuel which had previously occurred in engines having transfer ports (see 21*b*), as well as auxiliary ports sometimes referred to as booster ports. Previously, fuel inletted through the transfer port has to some extent flowed back through the booster port and passage and into the intake area, with a resultant loss of efficiency. This difficulty arose in prior constructions because of the position which earlier auxiliary ports occupied with relation to the direction of fuel introduced from the transfer port into the space above the piston. To avoid premature passage of fuel out of the cylinder through the exhaust port (see the port shown at 39 in FIGS. 3 and 4) it is common to introduce fuel through the transfer port so that it flows in a direction toward that side of the cylinder which is away from the exhaust port 39. This direction of flow is indicated by the flow arrow shown extending from the port 21*b* (FIG. 3). On the other hand, the booster port was generally located in vertical alignment with the intake porting, and the result has been a tendency for the fuel to short circuit out of the transfer port, into the booster port, and thence back into the intake area.

In my new arrangement shown in FIGS. 3 and 4, the auxiliary inlet-transfer port 36 is adjacent to the main transfer port 21*b*. Since both of the ports 21*a* and 36 are angularly spaced from the intake porting, in a plane transverse the cylinder axis, both "look" in generally the same direction across the cylinder, rather than generally confronting one another. Short circuiting is therefore eliminated, since the fuel, due to its velocity and kinetic energy, does not make the 180° turn which would be required to flow from the transfer port 21*b* into the auxiliary port 36.

As will be seen from the above, in the arrangement of FIGS. 3 and 4, provision is also made for intercommunication between the intake tract or passage and the transfer passages. Indeed, in this arrangement, a region of the intake tract and a region of the passage leading to the port 36 are common to each other, thereby providing for direct and effective supplementing of the fuel being transferred from the crankcase to the combustion chamber.

Figure 5:
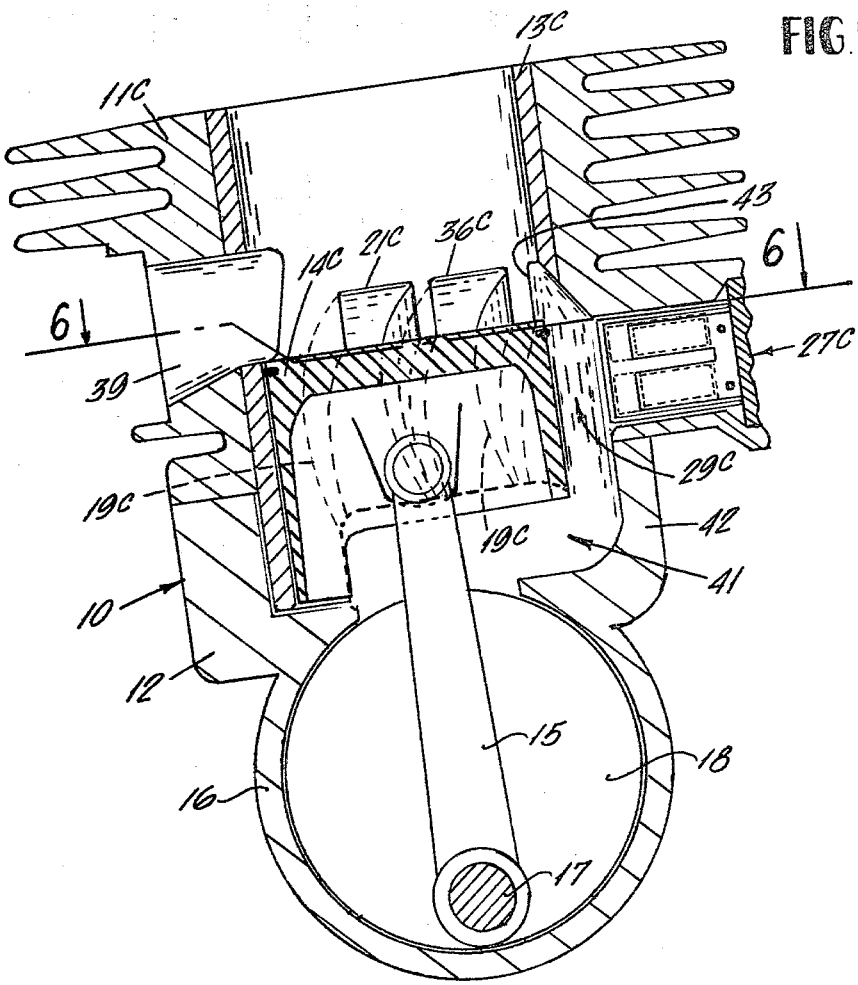
FIGS. 5 and 6 are views similar to FIGS. 1 and 2, illustrating a third embodiment of the invention.
Figure 6:
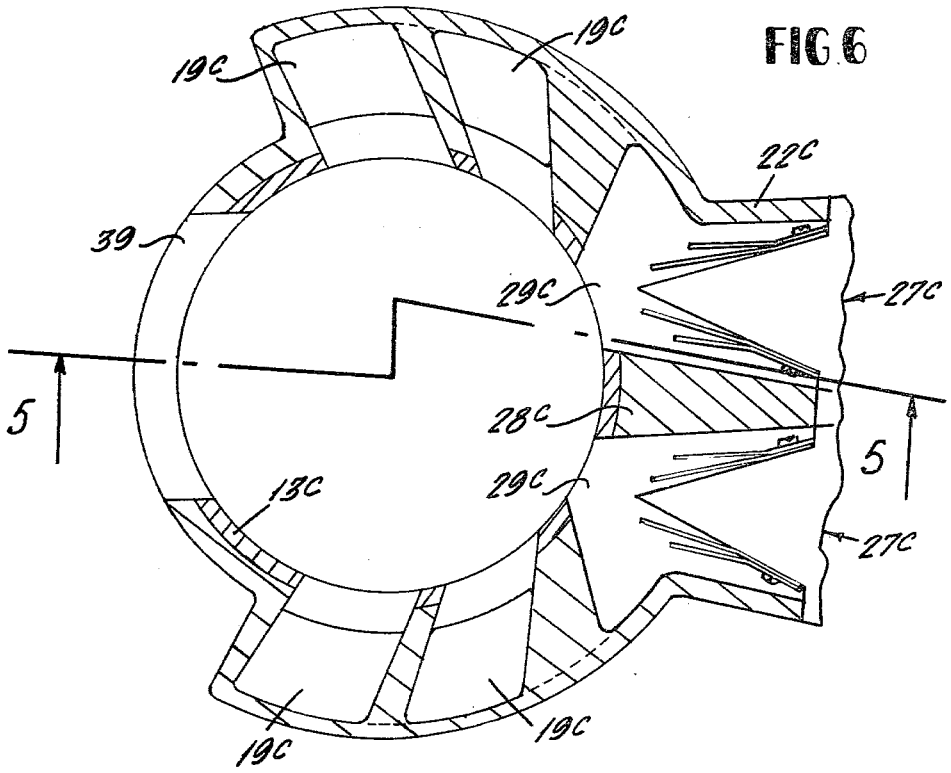

FIGS. 5 and 6

FIGS. 5 and 6 illustrate a third embodiment of Applicant's arrangements providing for augmenting the introduction of fuel into the combustion chamber by bringing certain transfer and intake passages into communication with each other. In these figures, certain of the basic parts of the engine are identified by reference numerals as used in some of the earlier figures, especially FIGS. 1 and 2; and in addition, certain parts are also identified by reference numerals similar to those employed in FIGS. 1 and 2 but including the subscript c.

It will be seen from inspection of FIGS. 5 and 6 that the arrangement here shown not only includes two transfer passages 19*c* at each side of the cylinder, but also includes a combined intake and transfer passage at each side. The combined intake and transfer passages are described below but it is first pointed out that the transfer passages are provided with appropriate ports into the combustion space and also have their lower ends communicating with a chamber 41 formed within the upper portion 12 of the engine housing 10, this chamber also communicating with the lower portion of the crankcase but being located above the crank and counterweight space immediately adjacent to the lower ends of the transfer passages.

As seen in FIGS. 5 and 6, the intake passages or tracts 29*c* downstream of the reed valves 27*c* have communication with the chamber 41 and the crankcase space; and this communication is arranged within the wall structure 42 in such manner as to remain open throughout the entire cycle of operation of the engine, including bottom dead center position of the piston. The intake passages or tracts 29*c* also extend upwardly for communication with the cylinder ports 43, one such port being provided for each of the passages 29*c*. These ports 43 are positioned at the same level in the cylinder as the ports 21*c* and 36*c* of the transfer passages 19*c*, and the ports 43 serve a similar function. It will be observed that the intake passages 29*c* receive fuel from the valves 27*c* in a region above the chamber 41 and intermediate the ports 43 and the zone in which the passages 29*c* communicate with chamber 41 and the crankcase. Therefore, during the lower portion of the downward or compression stroke of the piston, the intake passages 29*c* serve to deliver compressed fuel from the chamber 41 and thus from the crankcase upwardly into the combustion chamber, in the general manner of a transfer passage, but since these passages 29*c* have communication with the fuel supply, at least at higher speeds of operation, additional fuel is supplied to the flow by virtue of the action referred to herein as injector action.

It is also to be noted that since the chamber 41 in the immediate vicinity of the lower ends of the transfer passage 19*c* directly communicates with the intake passages or tracts 29*c*, under certain conditions of operation, the delivery of fuel into the combustion space through the transfer passages 19*c* is also augmented.

It will be noted that in effect at least a region of each passage 29*c* serves in part as an intake tract and in part as a transfer passage.

Figure 7:
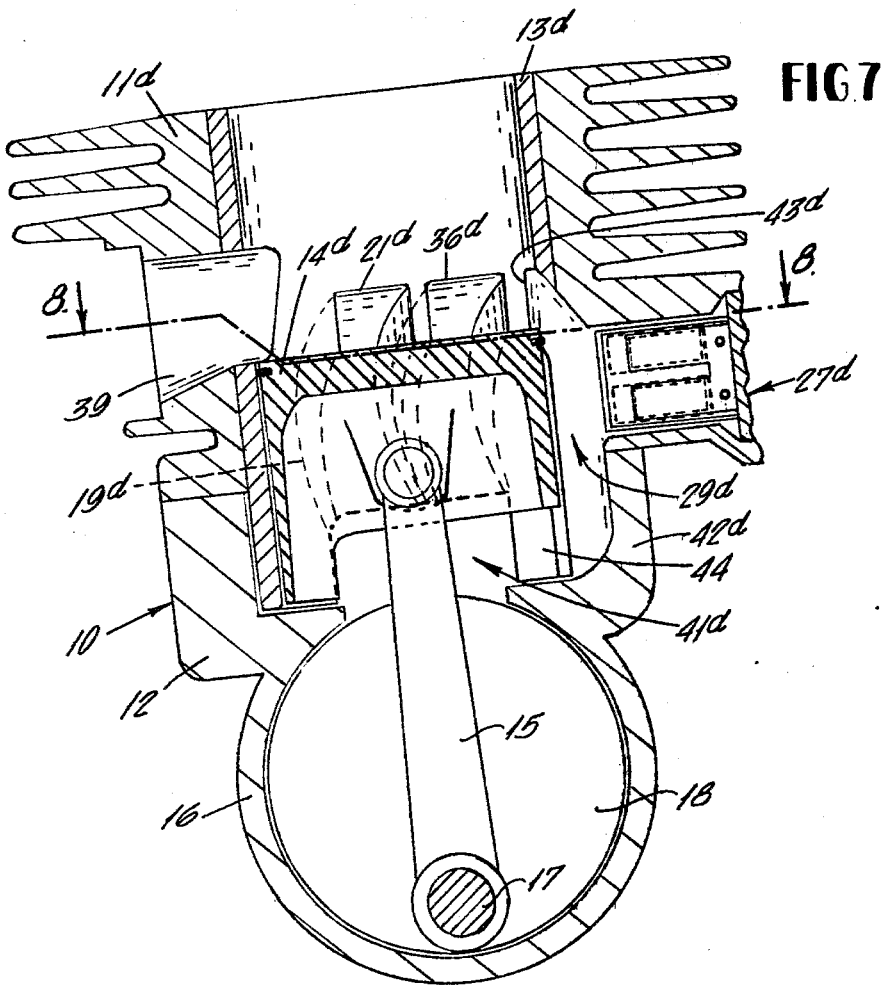
FIGS. 7 and 8 are views similar to FIGS. 1 and 2, and illustrating a fourth embodiment of the invention.
Figure 8:
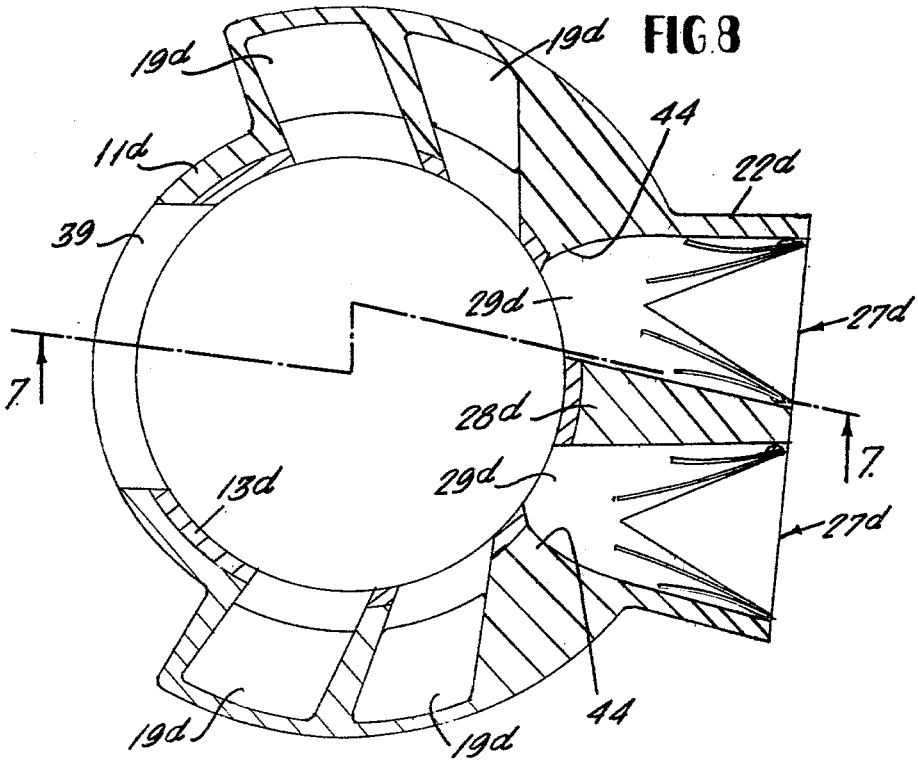

FIGS. 7 and 8

FIGS. 7 and 8 illustrate a fourth embodiment of applicant's arrangements providing for augmenting the introduction of fuel into the combustion chamber by bringing certain transfer and intake passages into communication with each other. In these figures, basic parts of the engine are again identified by reference numerals as used in earlier figures, especially FIGS. 1 and 2; and in addition, certain parts are also identified by reference numerals similar to those employed in various of the other figures, but including the subscript d.

In most respects, the arrangement of FIGS. 7 and 8 is very similar to the arrangement of FIGS. 5 and 6.

The principal difference between the arrangements of FIGS. 5 and 6 and FIGS. 7 and 8 is the downward extension in FIGS. 7 and 8 of the portion of the cylinder structure indicated at 44 below the piston, so that the communication of the intake tracts 29*d* with the chamber 41*d* adjacent the lower ends of the transfer passages is provided only through the space below the piston. This is in contrast with the arrangement of FIGS. 5 and 6 in which the communication of the intake tracts 29*c* with the chamber 41 and thus with the lower ends of the transfer passages is established not only in the space below the piston, but also around the lower edge portion of the piston even in bottom dead center position.

CONCLUSION

It is to be noted that in all of the embodiments illustrated, the intake tracts or passages from the fuel supply and valve cages are in constant communication with the crankcase space or chamber in a region below the piston throughout the entire cycle of operation of the engine including the bottom dead center position. This communication is maintained at normal operating speeds without requiring reversal of flow through the transfer passages; and as brought out in certain of my cross referenced applications and patents above identified, this is of importance in augmenting fuel input to the combustion chamber. It will further be seen that in all embodiments, a chamber (identified at 41 in FIGS. 5 and 6) is provided below the piston and above the crank and counterweight space in the crankcase, with which chamber not only the intake tract communicates but with which the inlet end of the transfer passages also communicate. This chamber is partially separated from the crank and counterweight space in the crankcase by the configuration of the wall structure of the engine housing. The intercommunicating opening between the chamber and the crank and counterweight space in the crankcase is, of course, adequate to accomodate the connecting rod 15 and its motions, but, particularly at high engine speeds, the crank and counterweight space is in effect a "dead" space and the chamber 41 is a "live" and very active space, through which fuel passes at high rate from the intake side of the system to the transfer side of the system, and thus to the combustion chamber. This fuel flow occurs at high engine speeds in a manner which is not substantially influenced by the fact that the chamber 41 is in communication with the crank and counterweight space. One of the reasons why this flow is not substantially influenced by the communication between the chamber and the crank and counterweight space is the fact that the chamber is immediately adjacent to the piston whereas the crank and counterweight space is remote from the piston and it is the piston motion which acts to reduce and increase the pressure in the chamber, as occurs on the suction and compression strokes of the piston. This action of the piston originates immediately under the piston and is, therefore, highly effective in providing the desired pressure fluctuations in the chamber; and at high speeds, such fluctuations are not communicated to any substantial extent downwardly in the more remote space where the crank and counterweight are enclosed in the engine housing, provided that the intake porting is located at least as high as the chamber.

As to most of the fuel flow passages, it is also of importance that complete reversal of the direction of flow is not required, as such reversal, particularly at high engine speeds, has a tendency to diminish delivery of fuel, because of the inertia of the fuel itself. Even in the case of the intake passages 29*c* and 29*d* of the embodiments of FIGS. 5–6 and 7–8, at normal operating speeds, the fuel flow through the passages 29*c* and 29*d* is in the upward direction throughout the cycle of operation and this is of importance in maintaining high velocity of flow and thereby provide the fuel injector effect contemplated according to the invention.

In all of the embodiments illustrated and described, the supply of fuel to the combustion space by virtue of transfer flow of the fuel from the compression side of the piston to the combustion side of the piston is augmented by an injector or induction type of action resulting in flow of some fuel from the intake or supply passages substantially directly into the transfer flow without previous compression in the space below the piston. This action is of appreciable effect over a substantial range of engine speeds and is particularly significant at high engine speeds.

In certain of the embodiments, injector passages are employed interconnecting the fuel supply tracts or passages with the transfer passages, and such injector passages may be either drilled in the wall of the cylinder or may be hogged out of the inside cylinder wall, so that the injector passages are defined in part by the piston itself. In certain embodiments, the injector intercommunication between the fuel supply passages and the transfer passages may also be provided by arrangement of those passages in a manner establishing a fuel flow region which is common both to a transfer passage and also to an intake tract, without the presence of a separate injector duct or passage interconnecting spaced intake and transfer passages.

I claim:

1. A variable speed, two-cycle, crankcase compression, internal combustion engine comprising a cylinder, a piston working in the cylinder, a crankcase, an intake port in the cylinder in fluid communication with the crankcase, an intake tract in fluid communication with the intake port, valve means disposed in the intake tract for controlling the flow of fluid therethrough, a transfer port in the cylinder, and a transfer passage, one end of which communicates with the transfer port and the other end of which communicates with the crankcase, below the piston, for conveying fluid from the crankcase to the transfer port, the communication of the intake port with the crankcase being independent of the transfer passage, and a region of the transfer passage intermediate its ends being in communication with the intake tract downstream of the valve means and providing for flow of fluid from the intake tract directly into the transfer passage.

2. An engine as defined in claim 1 in which the cylinder wall is recessed in said region of communication of the transfer passage with the intake tract, the recess having an opening confronting outside surface portions of the piston, whereby the recessed cylinder wall and said surface portions of the piston together define said communication.

3. A variable speed, two-cycle, crankcase compression, internal combustion engine comprising a cylinder having a combustion chamber, a piston working in the cylinder, a crankcase, port means in the cylinder including intake porting providing communication with the crankcase, an intake tract in fluid communication with the intake porting, valve means disposed in the intake tract for controlling the flow of fluid therethrough, the port means further including transfer porting communicating with the combustion chamber, and a transfer passage, one end of which communicates with the transfer porting and the other end of which communicates with the crankcase, below the piston, for conveying fluid from the crankcase to the transfer porting, the communication of the intake porting with the crankcase being independent of the transfer passage, and a region of the transfer passage intermediate its ends being in communication with the intake tract downstream of the valve means and providing for flow of fluid from the intake tract directly into the transfer passage.

4. An engine as defined in claim 3 and further including a transfer port in the cylinder communicating with the combustion chamber separately from said transfer porting, and transfer passage means communicating at one end with said separate transfer port and having its other end communicating with the crankcase.

5. An engine as defined in claim 4 and further including a passage communicating with the intake tract at a point downstream of the valve means and with the transfer passage means at a point between its crankcase end and said separate transfer port.

6. A variable speed, two-cycle, crankcase compression, internal combustion engine comprising a cylinder having a combustion chamber, a piston working in the cylinder, a crankcase, port means in the cylinder including intake porting confronting the piston in bottom dead center position and providing communication with the crankcase, an intake tract in fluid communication with the intake porting, valve means disposed in the intake tract for controlling the flow of fluid therethrough, the port means further including transfer porting, communicating with the combustion chamber, and a transfer passage formed in the cylinder, one end of which communicates with the transfer porting and the other end of which communicates with the crankcase, below the piston, for conveying fluid from the crankcase to the transfer porting, a region of the intake tract downstream of the valve means and a region of the transfer passage intermediate its ends being common to each other.

7. An engine as defined in claim 6 in which the intake porting and the transfer porting comprise separate ports.

8. An engine as defined in claim 6 in which the intake porting provides communication with the crankcase throughout the stroke of the piston between bottom and top dead center positions.

9. A variable speed, two-cycle, internal combustion engine comprising a crankcase and a cylinder having a combustion chamber, a piston working in the cylinder, the piston and cylinder being located and proportioned to provide a fuel chamber below the piston but above the crank space in the crankcase, port means in the cylinder including intake porting and passage means providing communication with said fuel chamber throughout the entire cycle of the engine, an intake tractin fluid communication with the intake porting, reed valve means disposed in the intake tract and located in a position confronting the bottom dead center position of the piston for controlling the flow of fluid through the intake tract, the port means further including transfer porting communicating with the combustion chamber, and a transfer passage formed in the cylinder and, one end of which communicates with the transfer porting and the other end of which communicates with said fuel chamber throughout the cycle of the engine for conveying fluid from the fuel chamber to the transfer porting, and the transfer passage being in communication with the intake tract downstream of the valve means and providing for flow of fluid from the intake tract directly into the transfer passage.

* * * * *